US010449602B2

(12) United States Patent
Ma et al.

(10) Patent No.: US 10,449,602 B2
(45) Date of Patent: Oct. 22, 2019

(54) MAGNESIUM ALLOY CAST-ROLLING UNIT

(71) Applicant: Taiyuan University of Science and Technology, Taiyuan (CN)

(72) Inventors: Lifeng Ma, Taiyuan (CN); Jingfeng Zou, Taiyuan (CN); Xiao Hu, Taiyuan (CN); Rongjun Wang, Taiyuan (CN); Guangming Liu, Taiyuan (CN); Zhiquan Huang, Taiyuan (CN); Yanchun Zhu, Taiyuan (CN); Qingxue Huang, Taiyuan (CN)

(73) Assignee: TAIYUAN UNIVERSITY OF SCIENCE AND TECHNOLOGY, Taiyuan (CN)

( * ) Notice: Subject to any disclaimer, the term of this patent is extended or adjusted under 35 U.S.C. 154(b) by 0 days.

(21) Appl. No.: 15/904,466

(22) Filed: Feb. 26, 2018

(65) Prior Publication Data

US 2018/0243821 A1 Aug. 30, 2018

(30) Foreign Application Priority Data

Feb. 24, 2017 (CN) ..... 2017 1 0101801
May 3, 2017 (CN) ..... 2017 1 0303137

(51) Int. Cl.

| | |
|---|---|
| ***B22D 11/06*** | (2006.01) |
| ***B22D 11/00*** | (2006.01) |
| *B22D 11/16* | (2006.01) |
| *B22D 11/124* | (2006.01) |

(52) U.S. Cl.

CPC ..... *B22D 11/0622* (2013.01); *B22D 11/001* (2013.01); *B22D 11/064* (2013.01); *B22D 11/0682* (2013.01); *B22D 11/0648* (2013.01); *B22D 11/1243* (2013.01); *B22D 11/161* (2013.01)

(58) Field of Classification Search

CPC . B22D 11/0622; B22D 11/001; B22D 11/064; B22D 11/0682; B22D 11/0648; B22D 11/1243; B22D 11/161; B22D 11/1287

See application file for complete search history.

(56) References Cited

U.S. PATENT DOCUMENTS

2007/0169914 A1* 7/2007 Nakayama ..... B22D 11/0682 164/428

* cited by examiner

*Primary Examiner* — Kevin P Kerns

*Assistant Examiner* — Steven S Ha

(74) *Attorney, Agent, or Firm* — Matthias Scholl P.C.; Matthias Scholl

(57) ABSTRACT

A magnesium alloy cast-rolling unit, including: a main body; a fluid supplier; an electric pushrod; a linkage mechanism; a horizontal platform; a screw; dovetail guide rails; and a bottom plate. The main body includes a base, a spring cylinder, a hydraulic adjustment cylinder, a connection portion, and a cast-rolling unit body. The connection portion includes an arc-shaped rail. The spring cylinder includes an actuation element. The actuation element includes a piston rod and a pressure strip. The piston rod includes an external thread at one end; and the pressure strip includes an internal thread corresponding to the external thread. The fluid supplier includes a head box, a corrugated pipe, a compression spring assembly including a gland cover, a connection pipe including a convex pipe joint and a concave pipe joint, a flat plate including a groove, a smelting furnace, and a horizontal operation platform.

5 Claims, 19 Drawing Sheets

MAGNESIUM ALLOY CAST-ROLLING UNIT

CROSS-REFERENCE TO RELATED APPLICATIONS

Pursuant to 35 U.S.C. § 119 and the Paris Convention Treaty, this application claims foreign priority to Chinese Patent Application No. CN201710101801.0 filed Feb. 24, 2017, and to Chinese Patent Application No. CN201710303137.8 filed May 3, 2017. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The disclosure relates to the field of continuous cast rolling of magnesium alloy, and more particularly to a magnesium alloy cast-rolling unit and a magnesium alloy cast-rolling apparatus comprising a temperature regulatable cast-rolling roller.

Description of the Related Art

In most conventional inclined cast-rolling units for magnesium alloys, a rolling mill frame is driven to rotate by a hydraulic system, and the rolling mill frame is fixed in an operating position by means of a self-locking hydraulic cylinder. Leakage of hydraulic fluid due to seal failure of the hydraulic cylinder and internal leaks causes the mill roller to deviate from an optimum angle of inclination over time and makes it impossible for a smelting furnace to be maintained at a predetermined height, causing severe impact on the quality of the cast-rolled sheet, changing the engagements between the rolling mill and the transmission, between the rolling mill and the head box, and between the head box and the smelting furnace, and causing safety problems.

Conventionally, when quality defects are found in magnesium alloys during cast-rolling, there is no solution other than stopping the cast-rolling unit, readjusting the angle of inclination of the cast-rolling unit and the positions of other casting-rolling devices, and replacing the pipeline between the head box and the smelting furnace. This leads to waste of material, lower work efficiency, and lower product yield.

Moreover, during cast rolling of magnesium alloys, the cast-rolled sheet is subjected to thermal effects such as heat radiation, convection, and frictional heating so that the temperature of the molten alloy varies along the width direction and has a significantly non-uniform distribution. In a conventional magnesium alloy cast-rolling unit, cooling water is injected through a single water inlet. As a result, the temperature along the width direction of the cast-rolling roller is not regulated per area during circulation of the cooling water. This leads to performance and quality defects in the cast-rolled sheet.

SUMMARY OF THE INVENTION

In view of the above-described problems, it is an objective of the disclosure to provide a magnesium alloy cast-rolling unit having improved reliability of self-locking and allowing for effective adjustment of the angle of inclination of the cast-rolling unit without replacing the connection pipeline between the head box and the smelting furnace.

Another objective of the disclosure is to provide a magnesium alloy cast-rolling apparatus comprising a temperature regulatable cast-rolling roller that can provide uniform temperature distribution along the direction of width of the magnesium alloy sheet throughout the cast-rolling process.

To achieve the objectives above, according to one aspect of the invention, there is provided a magnesium alloy cast-rolling unit, comprising a main body, a fluid supplier, a connection portion, a horizontal platform, a screw, and dovetail guide rails, in which the main body comprises a base, a spring cylinder, a hydraulic adjustment cylinder, and a cast-rolling unit body; and the fluid supplier comprises a head box, a corrugated pipe, a convex pipe joint, a compression spring assembly, a gland cover, a flat plate comprising a concave pipe joint, a bottom plate, a linkage mechanism, a smelting furnace, and a horizontal operation platform; the base is arranged horizontally on the ground and is hinged to the cast-rolling unit body, the connection portion comprising an arc-shaped rail is fixed to the cast-rolling unit body; the hydraulic adjustment cylinder is disposed between the cast-rolling unit body and the base and is hinged to the cast-rolling unit body at one end and to the base at the other end, such that when the hydraulic adjustment cylinder is driven by a hydraulic pump, the head box fixed to the cast-rolling unit body is tilted as the cast-rolling unit is tilted; the spring cylinder is fixed to the base; the bottom plate and the horizontal platform are hinged to each other via the linkage mechanism, an electric pushrod is fixed to two horizontal rods of the linkage mechanism, the horizontal operation platform and the screw for horizontal adjustment of the horizontal operation platform are mounted on the horizontal platform, the screw is driven by a motor, and the dovetail guide rails are arranged vertically to the horizontal platform and the bottom plate; and a smelting furnace operation platform is horizontally arranged on the ground, the smelting furnace is fixed to the horizontal operation platform, the head box and the convex pipe joint are connected to each other via the corrugated pipe, and a gap between the convex pipe joint and the flat plate with the concave pipe joint after adjustment is compensated by preload of the compression spring assembly and expansion or contraction of the corrugated pipe.

In a class of this embodiment, the spring cylinder further comprises a disc spring. The spring cylinder comprises an actuation element which comprises a piston rod and a pressure strip; one end of the piston rod comprises an external thread, and the pressure strip comprises an internal thread. The pressure strip with the internal thread is shaped according to the connection portion so as to increase the contact area improving the locking effect of the spring cylinder.

In a class of this embodiment, the concave pipe joint and the convex pipe joint comprises respectively a concave joint surface and a convex joint surface; the two joint surfaces to be engaged are spherical surfaces of the same curvature and have different heights of the concave or convex portion; and at the connected portion, the connection pipe connected to the head box is pressed by the spring group against the flat plate with the concave pipe joint at the top of the smelting furnace through contact between the flanges of the concave pipe joint and the convex pipe joint.

In a class of this embodiment, an inner wall of the horizontal platform is provided with a rail for horizontal movement of the horizontal operation platform.

In a class of this embodiment, the spring group is pressed against the flanges of the concave pipe joint and the convex pipe joint in such a manner that the two spherical joint surfaces are brought into contact under pressure from the spring group, while being capable of rotation in a narrow range.

Because the concave pipe joint and the convex pipe joint are utilized instead of conventional joints, in the case of quality defects found in the magnesium alloy sheet during rolling, the configuration of the pipe joints in combination with the adjustment mechanism for the angle of inclination of the rolling mill allows for fine adjustment of the angle of inclination during cast-rolling.

In a class of this embodiment, the spring cylinder is operated in the following manner: a hydraulic pump supplies hydraulic fluid to overcome the elasticity of the disc spring so as to drive the piston rod with the external thread to pass through the base and the connection portion with the arc-shaped rail in sequence, whereupon the pressure strip with the internal thread is connected to the piston rod with the external thread via a screw pair, whereupon the hydraulic pump starts to release fluid, and the pressure strip with the internal thread is brought into contact with the connection portion and the base under the restoring force of the disc spring for the purpose of fixation.

In a class of this embodiment, the hydraulic pump supplies fluid to the spring cylinder, such that the pressure strip with the internal thread is disconnected from the connection portion with the arc-shaped rail, whereupon the locking function of the spring cylinder is temporarily disenabled; whereupon the hydraulic pump starts to supply fluid to the hydraulic adjustment cylinder, and the hydraulic adjustment cylinder drives the cast-rolling unit body into rotation around the portion where the base is hinged to the cast-rolling unit body; once the cast-rolling unit body is rotated to a predetermined angle of inclination the hydraulic pump for supplying fluid to the spring cylinder starts to release fluid, the pressure strip with the internal thread is brought into contact with the connection portion with the arc-shaped rail under effect of the disc spring, whereupon the spring cylinder resumes its locking function. In this way, the cast-rolling unit is fixed at a predetermined angle of inclination by the spring cylinder over a long period of time, and adjustment to the cast-rolling unit body is completed.

At this point, adjustment to the position of the smelting furnace begins. The motor is started up to provide power to the electric pushrod, such that the horizontal platform is vertically moved along the dovetail guide rail up to a predetermined height, then adjustment in the vertical direction is completed; whereupon the screw is turned to adjust the position of the horizontal operation platform. At this point, the corrugated pipe and the pipe joints serve to alleviate the situation where the flanges of the pipe joints are unparallel to the normal to an upper surface of the smelting furnace caused by change in the angle of inclination.

Advantages of the cast-rolling unit of the disclosure are summarized as follows: the spring cylinder can improve reliability of the self-locking function effectively. The spring cylinder has a simple structure and a small weight, and allows for convenient and reliable operation and easy disassembly and maintenance. The configuration of the pipe joints in combination with the adjustment mechanism for the angle of inclination of the cast-rolling unit allows for adjustment to the angle of inclination during cast rolling, thereby improving the yield of the magnesium alloy sheet. The special pipe joints are designed in such a manner that the connection pipe between the head box and the smelting furnace does not need to be replaced after adjustment to the rolling mill angle of inclination, thereby reducing the costs.

According to another aspect of the invention, there is provided a magnesium alloy cast-rolling apparatus that can provide uniform temperature distribution along the direction of width of the magnesium alloy sheet throughout the cast-rolling process.

In a class of this embodiment, the cast-rolling apparatus comprises a DC motor, a reducer gearbox, a two-stage cycloid pinwheel reducer, a cross-shaft universal coupling, a mill frame, a temperature regulatable cast-rolling roller, a screw-up cylinder, a spraying device, a guide roller, and a universal shaft end, in which the temperature regulatable cast-rolling roller is installed on the mill frame and connected to the cross-shaft universal coupling via the universal shaft end, and the cross-shaft universal coupling is connected to the reducer gearbox, the two-stage cycloid pinwheel reducer, and the DC motor.

In a class of this embodiment, the temperature regulatable cast-rolling roller comprises a bearing seat, a bearing, a roller shell, a cast-rolling roller core comprising cooling system, a quick-change flange, a water inlet gland cover, a water inlet pipe, a water outlet collect box, a water outlet pipe, a cooling water inlet and outlet pipe, and a temperature regulation device; in which the roller core with a cooling system comprises cooling water passageways, the water inlet gland cover is connected to the water inlet pipe via the quick-change flange, the water inlet pipe is connected to the temperature regulation device, and two adjacent passageways in the roller core are disposed orthogonally.

In a class of this embodiment, the roller body of the temperature regulatable cast-rolling roller comprises three areas. The three areas comprise a first area, a second area, and a third area.

In a class of this embodiment, the temperature regulation device comprises a detachable throttle pipe, a first throttle device, and a second throttle device; the first throttle device is installed in the first area, and the second throttle device is installed between the second area and the third area.

In a class of this embodiment, the first throttle device and the second throttle device are engaged to each other via a pair of discs with distributed orifices.

In a class of this embodiment, the cast-rolling apparatus comprises an infrared roller surface temperature scanner and a roller body thermocouple sensor scanner, in which the infrared roller surface temperature scanner is provided on the mill frame to measure the surface temperature of the cast-rolling roller.

Advantages of the cast-rolling apparatus of the disclosure are summarized as follows: Cooling water is introduced into the cast-rolling roller body cooling water circulation system. Based on the temperature measured by the temperature sensor, water flow in various areas are regulated by the temperature regulation device. As such, the drawbacks of existing sheet cast-rolling processes, such as uneven heating, difficult temperature regulation, and low yield of strips, can be overcome. Compared with conventional techniques, the disclosure has advantages of well controlled cast-rolling roller temperature, uniformity of cast-rolling roller temperature, and improved yield of strips.

Figure 1:
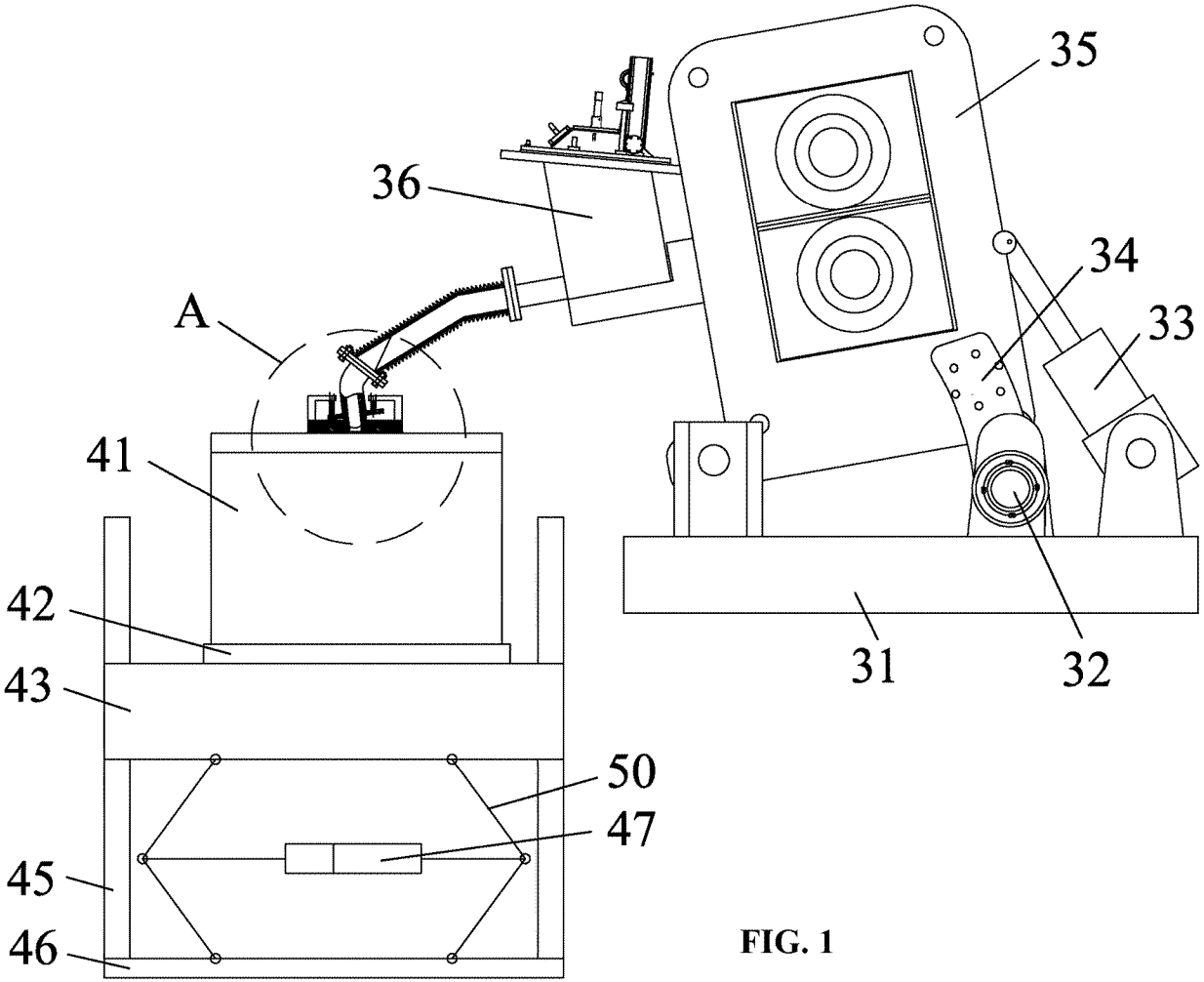
FIG. 1 is an overall side view of a magnesium alloy cast-rolling unit according to the disclosure.

In the drawings, the following reference numbers are used: 1. DC motor; 2. reducer gearbox; 3. two-stage cycloid pinwheel reducer; 4. cross-shaft universal coupling; 5. mill frame; 6 and 7. temperature regulatable cast-rolling rollers; 8. spraying device; 9. screw-up cylinder; 10. guide roller; 11. coupling shaft transitional plate; 12. jaw flexible coupling; 13. universal shaft end; 14 and 18. bearing seat; 15. bearing; 16. roller shell; 17. roller core with a cooling system; 19. quick-change flange; 20. water inlet gland cover; 21. water inlet pipe; 22. cooling water outlet; 23. water outlet pipe; 24 and 25. bearing cooling water inlet and outlet; 26. temperature regulation device; 27 simple throttle device; 28. detachable throttle pipe; 29. first throttle device; 30. second throttle device; 31. base; 32. spring cylinder; 33. hydraulic adjustment cylinder; 34. connection portion with an arc-shaped rail; 35. cast-rolling unit body; 36. head box; 37. gland cover; 38. corrugated pipe; 39. compression spring assembly; 40. flat plate with a concave pipe joint; 41. smelting furnace; 42. horizontal operation platform; 43. horizontal platform; 44. screw; 45. dovetail guide rail; 46. bottom plate; 47. electric pushrod; 48. pressure strip; 49. piston rod; 50. linkage mechanism; and 51. convex pipe joint.

DETAILED DESCRIPTION OF THE EMBODIMENTS

To further illustrate the invention, experiments detailing a magnesium alloy cast-rolling unit are described below. It should be noted that the following examples are intended to describe and not to limit the invention.

Figure 2:
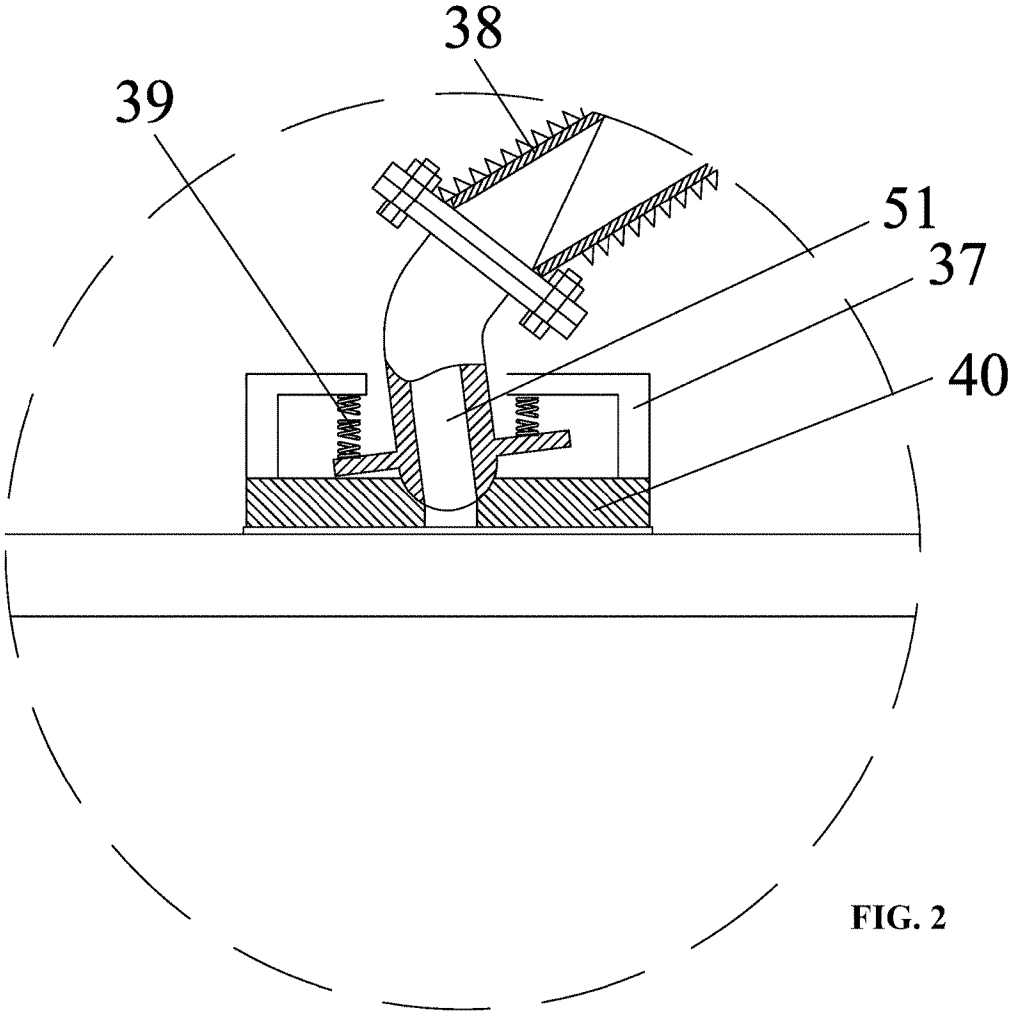
FIG. 2 is a partial enlarged view of a pipe joint of the magnesium alloy cast-rolling unit in portion A of FIG. 1.

As shown in FIG. 1, a magnesium alloy cast-rolling unit according to one disclosure comprises a main body and a fluid supplier. The main body comprises a base 31, a spring cylinder 32, a hydraulic adjustment cylinder 33, a connection portion 34 with an arc-shaped rail, and a cast-rolling unit body 35. The fluid supplier comprises a head box 36, a corrugated pipe 38, a compression spring assembly 39 comprising a gland cover 37, a flat plate 40 comprising a concave pipe joint, a smelting furnace 41, a horizontal operation platform 42, and a convex pipe joint 51. The base 31 is arranged horizontally on the ground. The base 31 is hinged to the cast-rolling unit body 35. The connection portion 34 with the arc-shaped rail is fixed to the cast-rolling unit body 35. The hydraulic adjustment cylinder 33 is disposed between the cast-rolling unit body 35 and the base 31, and is hinged to the cast-rolling unit body 35 at one end and hinged to the base 31 at the other end, such that when the hydraulic adjustment cylinder 33 is driven by a hydraulic pump, the head box 36 fixed to the cast-rolling unit body 35 can be tilted as the cast-rolling unit is tilted. The spring cylinder 32 is fixed to the base 31. The bottom plate 46 and the horizontal platform 43 are hinged to each other via a linkage mechanism. The electric pushrod 47 drives the horizontal platform 43 at the top of the linkage mechanism to adjust its vertical position. An operation platform 42 and a screw 44 for horizontal adjustment of the operation platform 42 are mounted on the horizontal platform 43. The screw 44 is driven by a motor. A dovetail guide rail 45 arranged vertically between the horizontal platform 43 and the bottom plate 46 allows only vertical movement of the horizontal platform 43. The smelting furnace 41 is fixed to the horizontal operation platform 42. The head box 36 and the smelting furnace 41 are connected to each other via a concave pipe joint flat plate 40 and a convex pipe joint 39 with a configuration as shown in FIG. 2, in which one of the two joint surfaces is concave and the other is convex. The two joint surfaces to be engaged are spherical surfaces of the same curvature and different heights of concave or convex portion.

Figure 5:
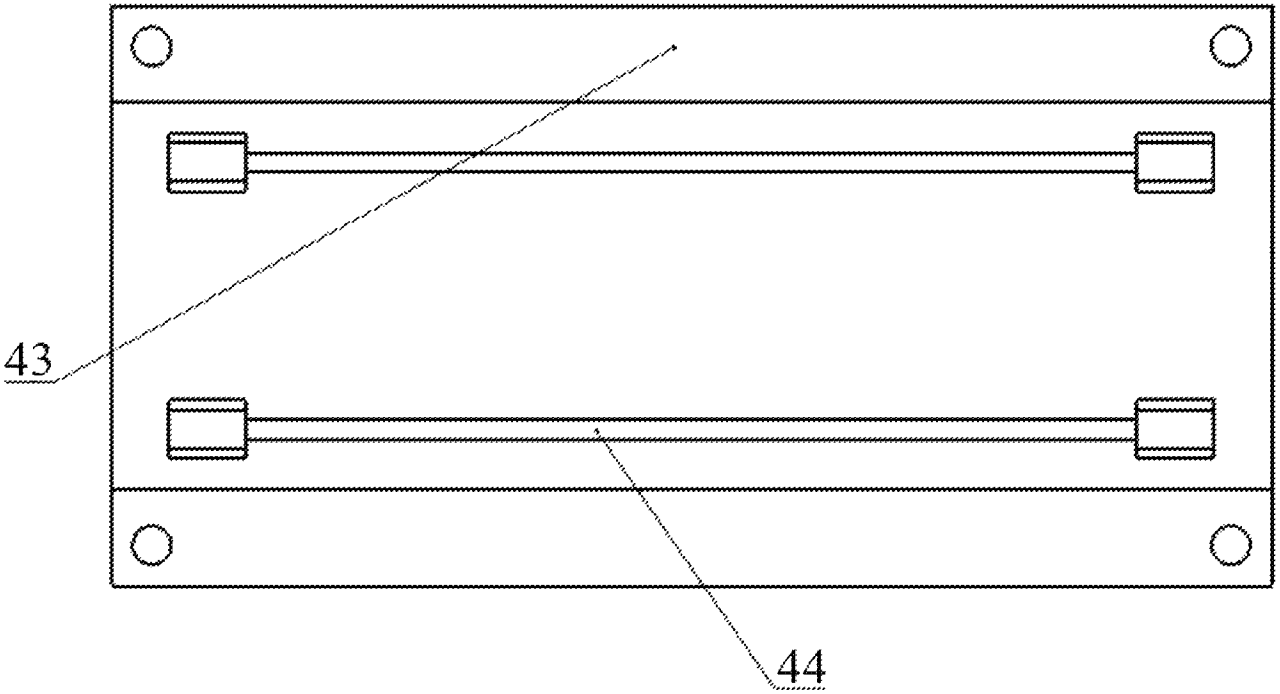
FIG. 5 is a top view of a horizontal platform.
Figure 6:
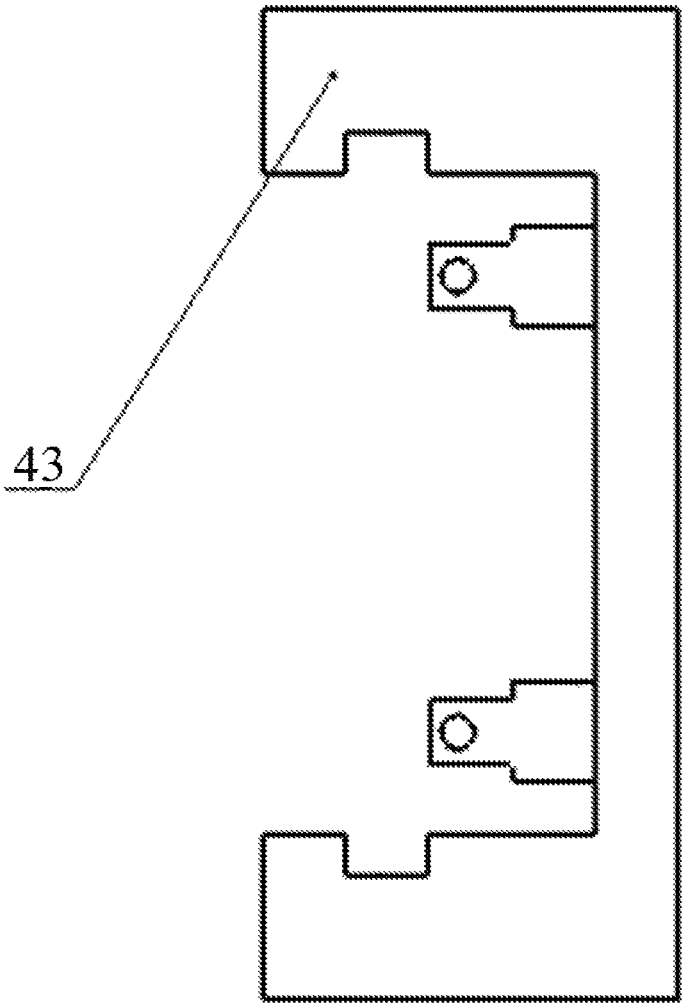
FIG. 6 is a side view of the horizontal platform.
Figure 7:
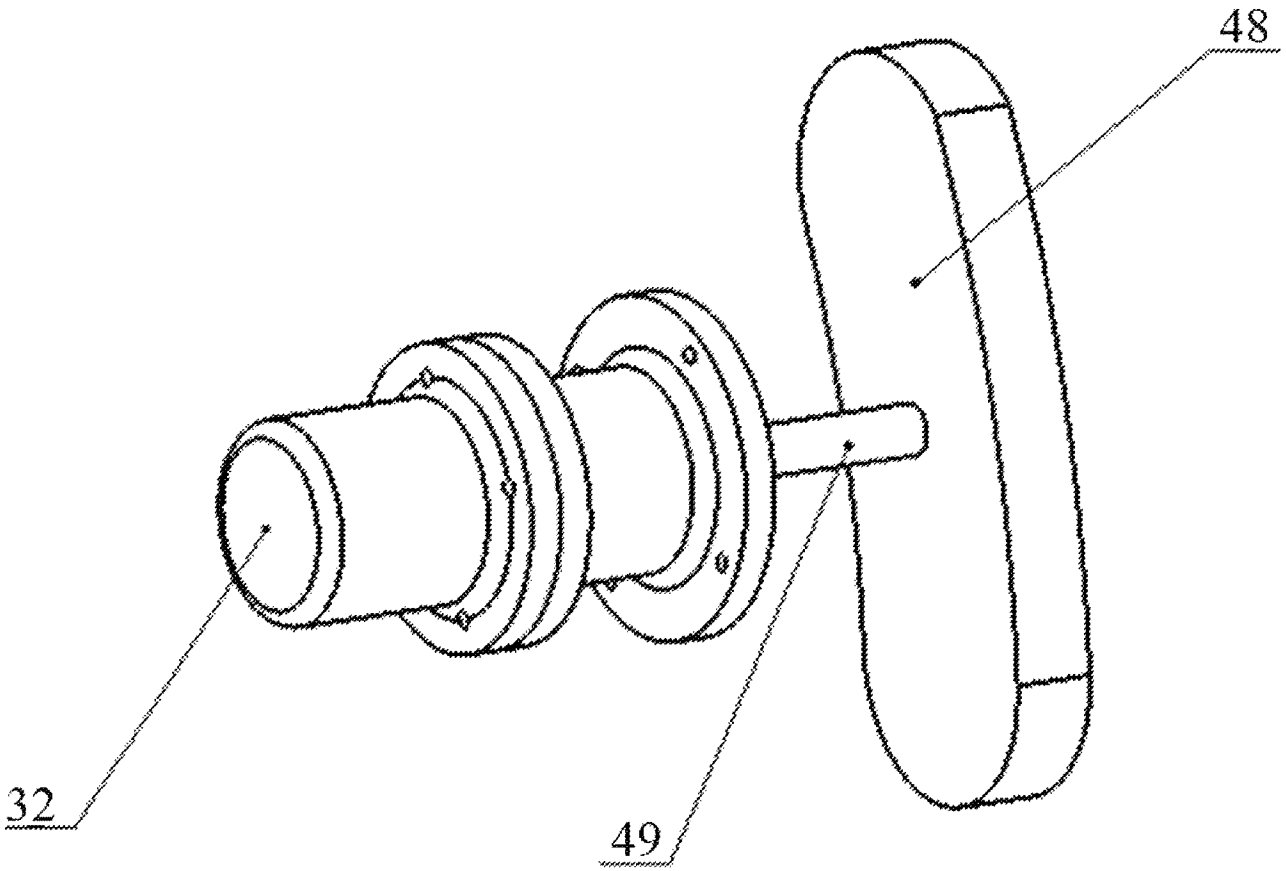
FIG. 7 is a schematic view showing a spring cylinder.

As shown in FIG. 5, an inner wall of the horizontal platform is provided with a rail for horizontal movement of the horizontal platform. As shown in FIG. 7, an actuation element of the spring cylinder 32 consists of a piston rod 49 and a pressure strip 48. The piston rod 49 has an external thread at one end, and the pressure strip 48 has an internal thread. The pressure strip 48 with the internal thread is shaped with reference to the connection portion 34 with the arc-shaped rail, so as to increase the contact area in order to improve the locking effect of the spring cylinder 32.

As shown in FIGS. 1 and 2, the corrugated pipe can dampen part of the change in position and angle of the head box and the smelting furnace relative to each other caused by adjustments to the angle of inclination of the rolling mill. Furthermore, the concave pipe joint and the convex pipe joint are brought into contact by the compression spring assembly, while the two spherical surfaces thereof are capable of rotation in a narrow range, thereby allowing the compression amount of the spring group to vary with variation of the operating position.

Figure 3:
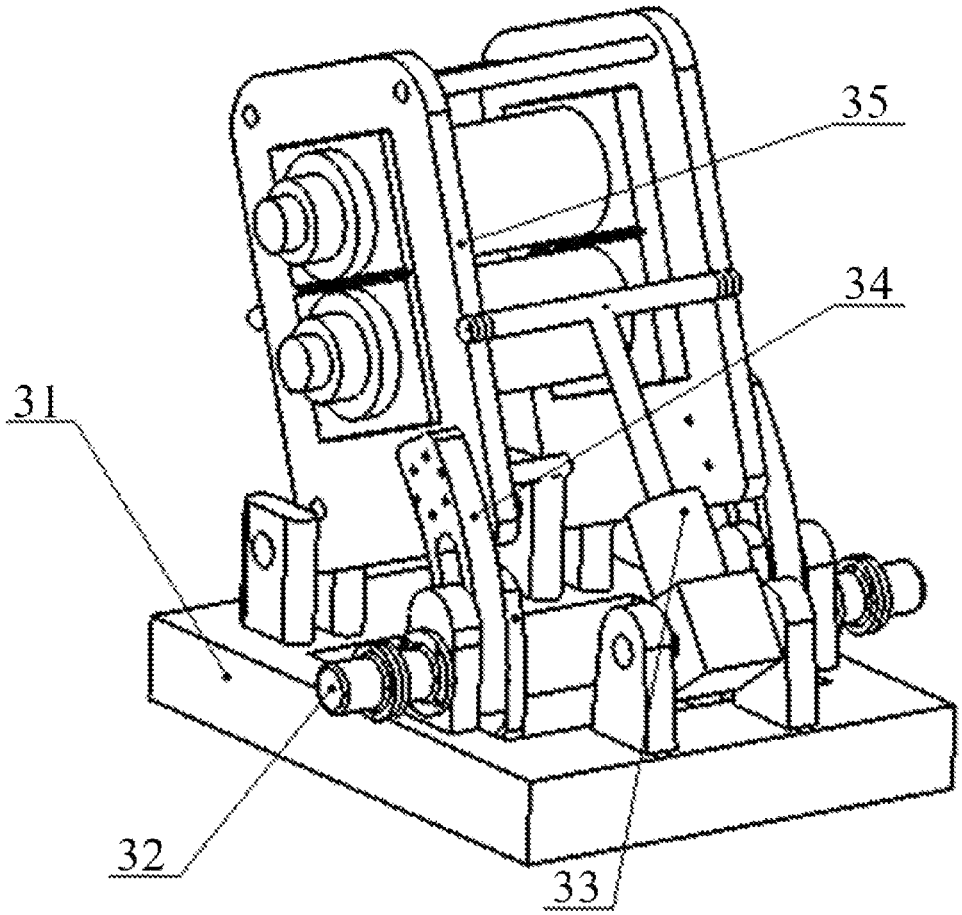
FIG. 3 is a schematic view of a spring cylinder and a hydraulic cylinder of the magnesium alloy cast-rolling unit according to the disclosure.
Figure 4:
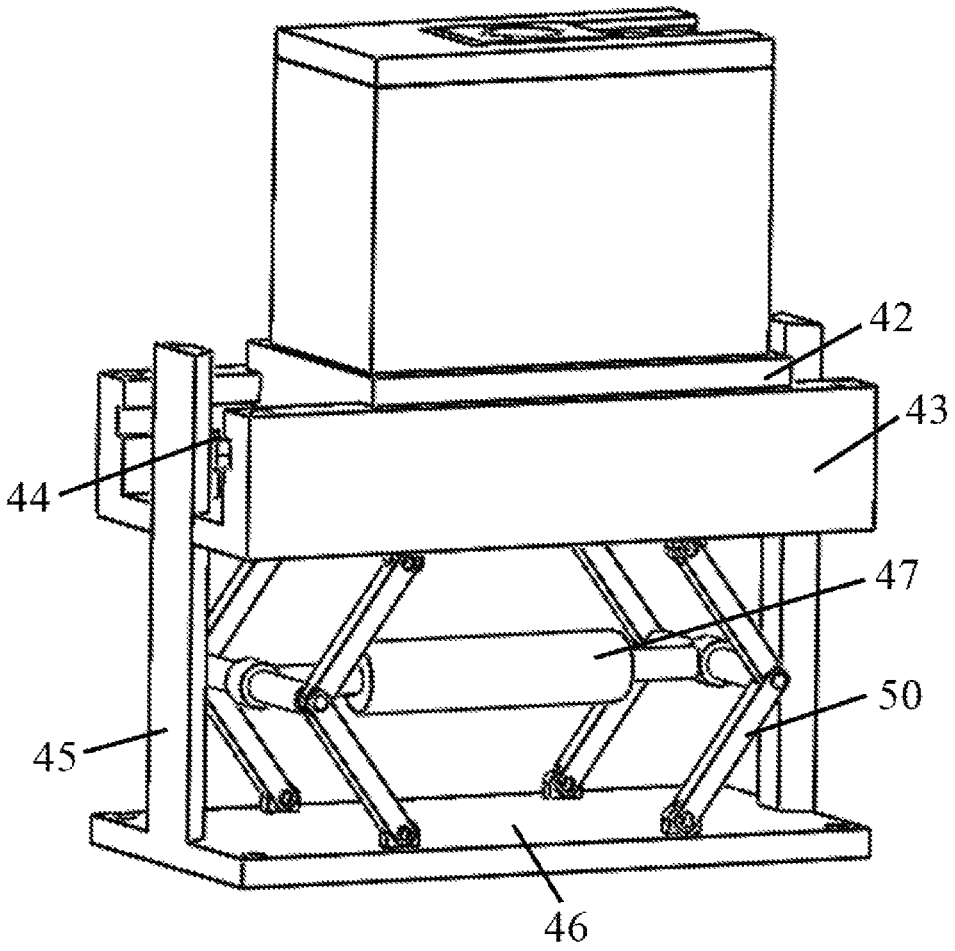
FIG. 4 is a three-dimensional schematic axonometric view of a smelting furnace operation platform.

Example 1: Adjustment to the Angle of Inclination of the Cast-rolling Unit Before Cast Rolling As shown in FIGS. 1, 3, and 7, the hydraulic pump supplies fluid to the spring cylinder 32 such that the locking function of the spring cylinder 32 is temporarily disabled. Then the overall angle of inclination of the magnesium alloy cast-rolling unit is adjusted by using the hydraulic adjustment cylinder 33. The hydraulic pump supplies fluid to the hydraulic adjustment cylinder 33, such that the cast-rolling unit is tilted to a predetermined angle of inclination. Then the hydraulic pump for fluid supply to the spring cylinder 32 is unloaded, such that the pressure strip with the internal thread 48, the connection portion 34 with the arc-shaped rail, and the base 31 are brought into contact by the restoring force generated by the disc spring. As such, the spring cylinder 32 serves to fix the magnesium alloy cast-rolling unit. Then the hydraulic pump for supplying fluid to the hydraulic adjustment cylinder 33 stops fluid supply and adjustment to the cast-rolling unit body 35 is completed. On the other hand, the motor starts to drive the electric pushrod 47 to move upward vertically to a specified height. Then the motor turns the screw 47 until proper adjustment is made to the horizontal position, and then the space between the gland cover and the flat plate with the concave pipe joint is finely adjusted manually. The spherical surfaces of the convex pipe joint 38 and the flat plate with the concave pipe joint 40 are arranged to be tangent to each other, and the space between the convex pipe joint 38 and the flat plate with the concave pipe joint 40 is reduced under the pressing force from the gland cover 37 and the compression spring assembly 39, such that a tight seal is formed between the convex pipe joint 38 and the flat plate with the concave pipe joint 40.

Example 2: Adjustment to the Angle of Inclination of the Cast-rolling Unit During Cast Rolling If quality defects are found in the magnesium alloy during rolling, the angle of inclination of the magnesium alloy cast-rolling unit needs to be finely adjusted. FIG. 2 shows the relative position of the special pipe joints prior to further adjustment, which provides guidance for adjusting the angle of inclination of the magnesium alloy cast-rolling unit to a modified angle of inclination during cast-rolling.

The hydraulic pump starts to supply fluid to the spring cylinder 32, such that the locking function of the spring cylinder 32 is temporarily disenabled. Then the hydraulic adjustment cylinder 33 is operated until the cast-rolling unit body 35 reaches the modified angle of inclination. It is to be noted that while the hydraulic adjustment cylinder 33 is being adjusted, the electric pushrod 47 should drive the smelting furnace 41 to move upward over a corresponding distance, and then the screw 44 drives the smelting furnace for synchronous adjustment in the horizontal direction. Then the hydraulic pump for supplying fluid to the spring cylinder 32 is unloaded, such that the pressure strip with the internal thread 48 are brought into contact with the connection portion 34 and the base 31 by the restoring force generated by the disc spring. In this way, the spring cylinder 32 resumes the locking function, thereby fixing the magnesium alloy cast-rolling unit. The present magnesium alloy cast-rolling unit has advantages over conventional cast-rolling units in that it can improve the reliability of the locking function effectively; it allows for adjustment of the angle of inclination during cast rolling, thereby increasing the yield of the magnesium alloy sheet; and the special pipe joints are designed in such a manner that after adjustment to the angle of inclination of the rolling mill, the connection pipeline between the head box and smelting furnace does no need to be replaced, thereby decreasing the costs.

Example 3

Figure 8:
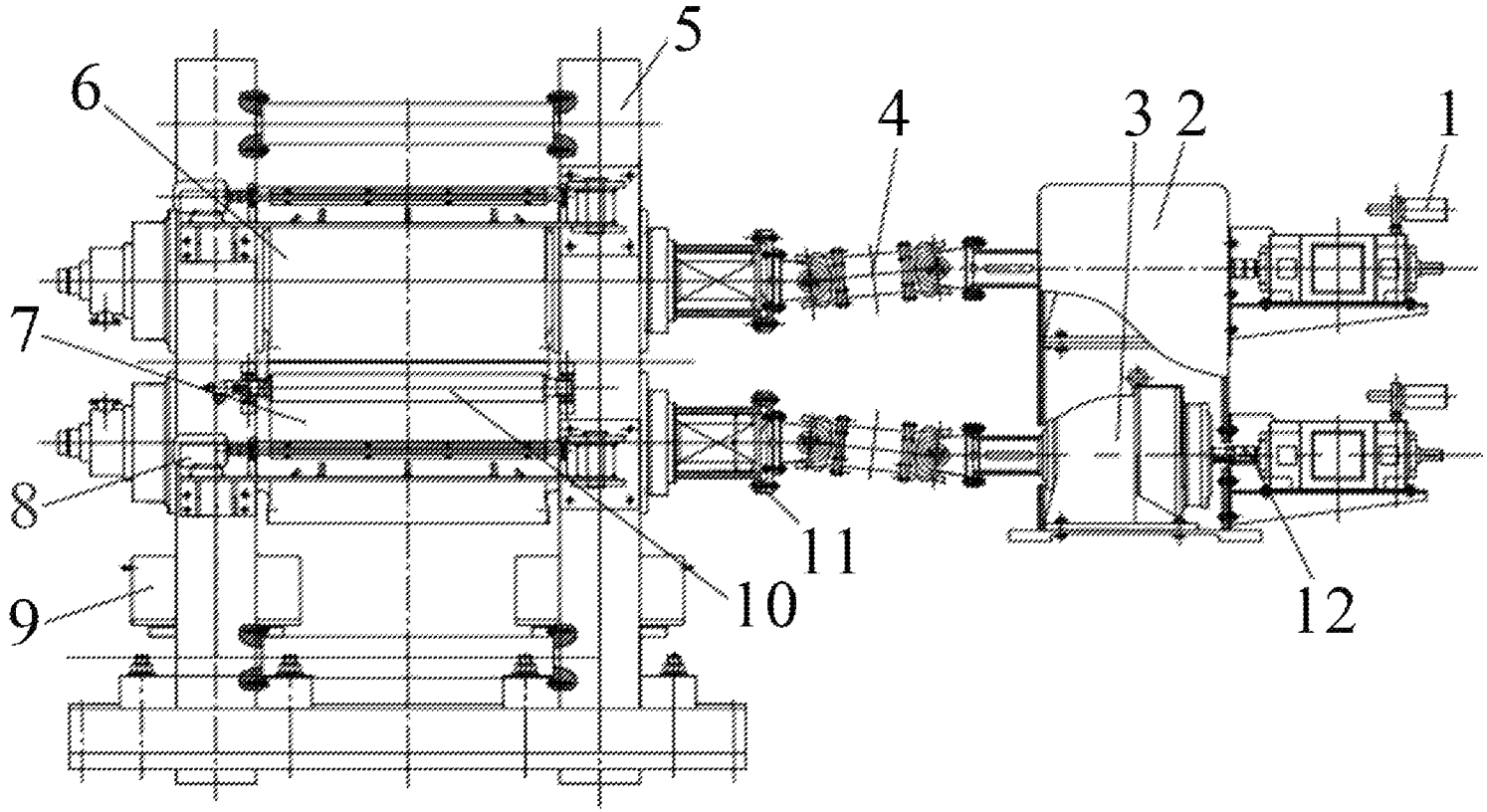
FIG. 8 is an overall schematic view of a cast-rolling unit apparatus of the disclosure.

As shown in FIG. 8, a cast-rolling apparatus with a temperature regulatable cast-rolling roller comprises a mill frame 5, temperature regulatable cast-rolling rollers 6 and 7, a screw-up cylinder 9, a spraying device 8, and a guide roller 10. The temperature regulatable cast-rolling rollers 6 and 7 are mounted on the mill frame 5 and are connected to the cross-shaft universal coupling 14 via a universal shaft end 13 after transition by a transitional plate 11. The cross-shaft universal coupling 14 connects the reducer gearbox 2, the two-stage cycloid pinwheel reducer 3, and the DC motor 1, in which the two-stage cycloid pinwheel reducer 3 and the DC motor 1 are connected to each other via a transitional FL jaw flexible coupling 12.

Figure 9:
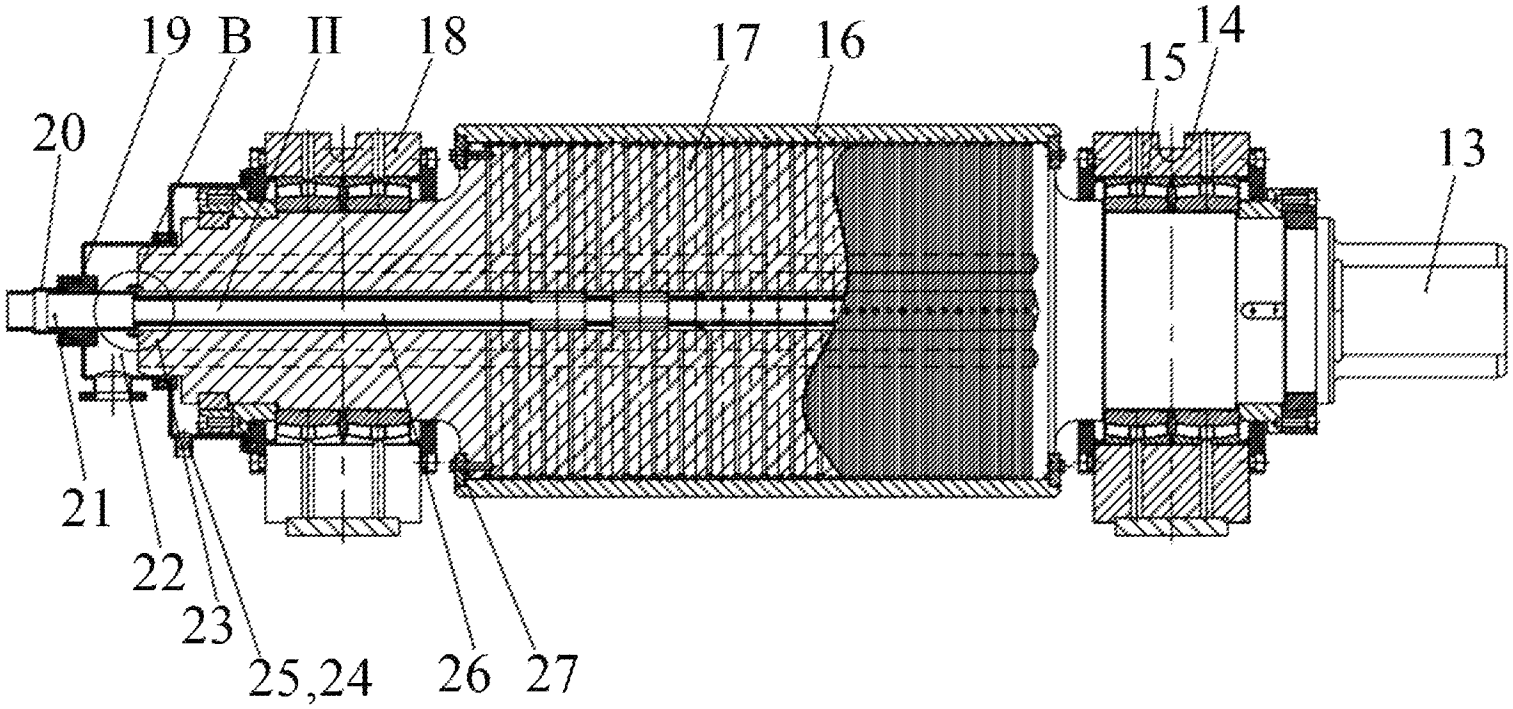
FIG. 9 is a schematic view of a temperature regulatable cast-rolling roller according to the disclosure.
Figure 10:
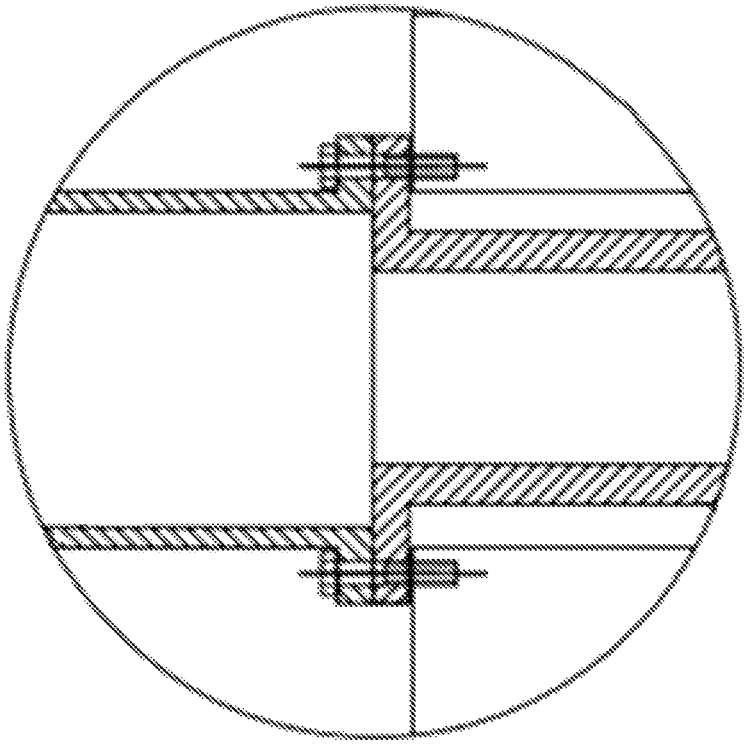
FIG. 10 is a partial enlarged view showing a connected portion of a detachable throttle pipe.
Figure 11:
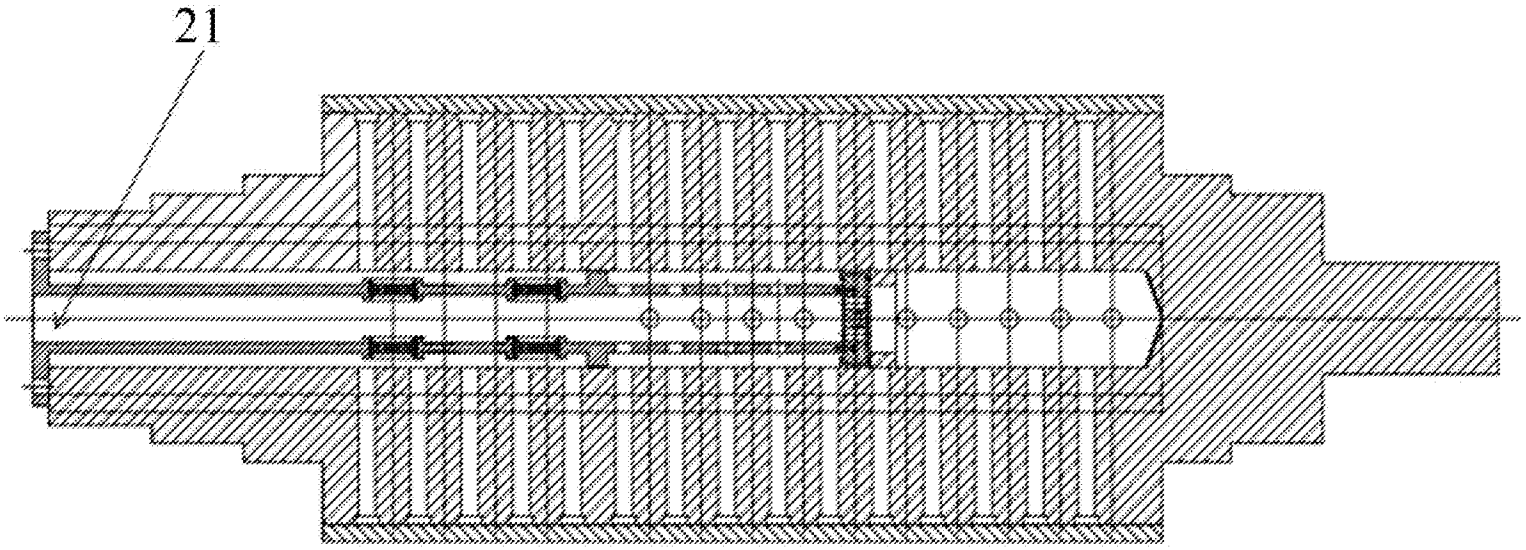
FIG. 11 is a schematic view showing assembly of the detachable throttle pipe of the temperature regulation device with the cast-rolling roller in accordance with one embodiment of the disclosure.
Figure 12:
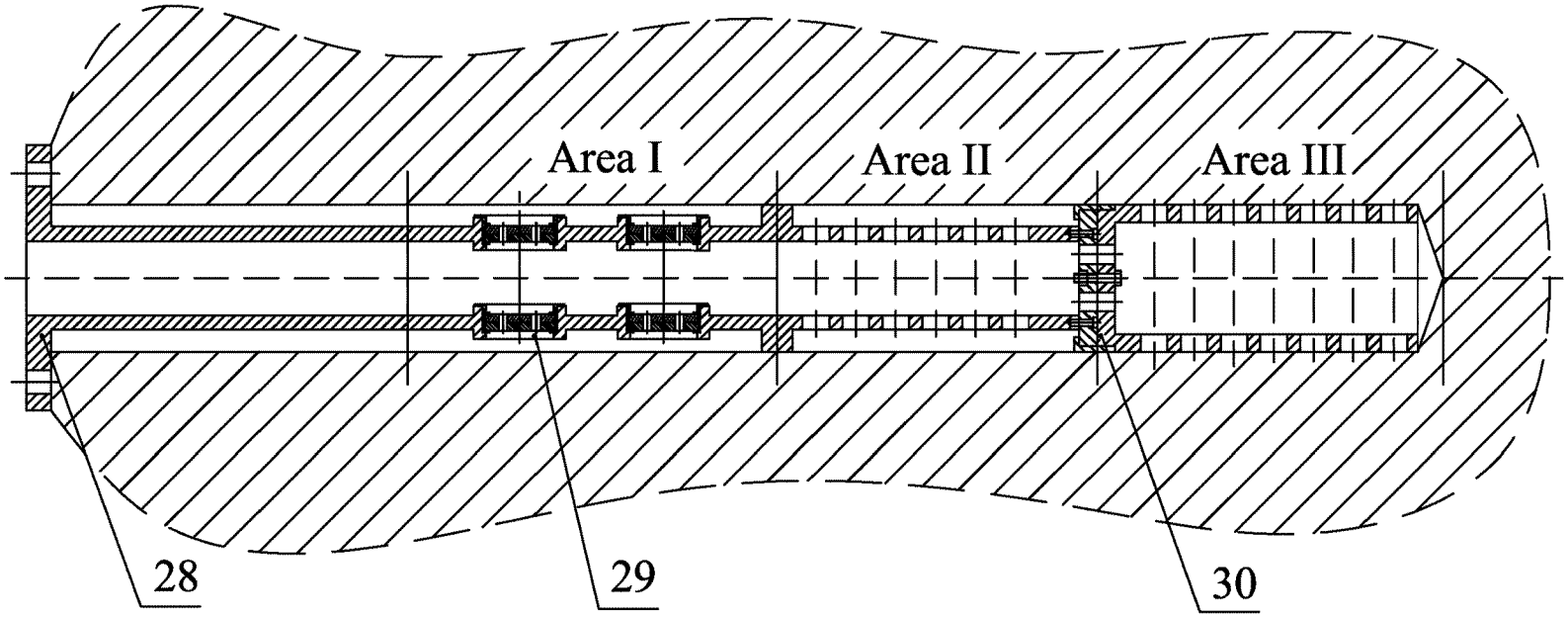
FIG. 12 is a schematic view showing assembly of the detachable throttle pipe of the temperature regulation device in accordance with one embodiment of the disclosure.
Figure 13A:
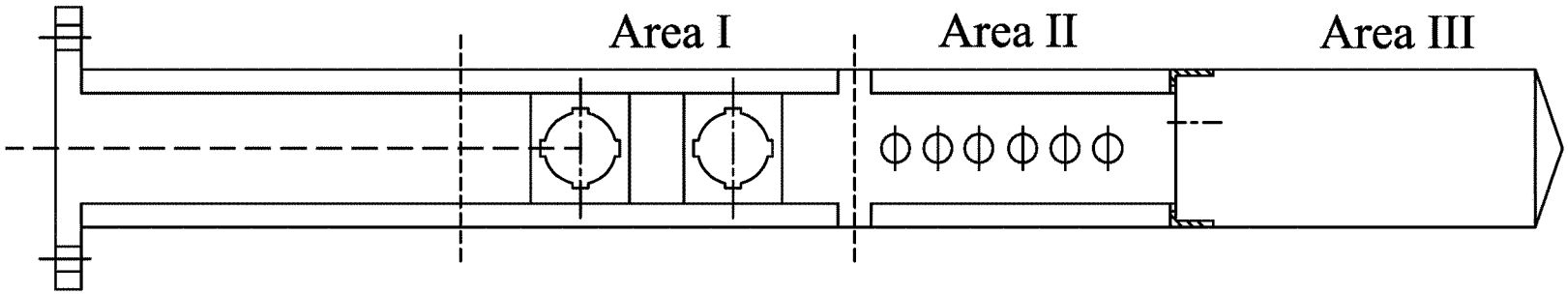
FIG. 13A is a top view of the detachable throttle pipe of the temperature regulation device in accordance with one embodiment of the disclosure.
Figure 13B:
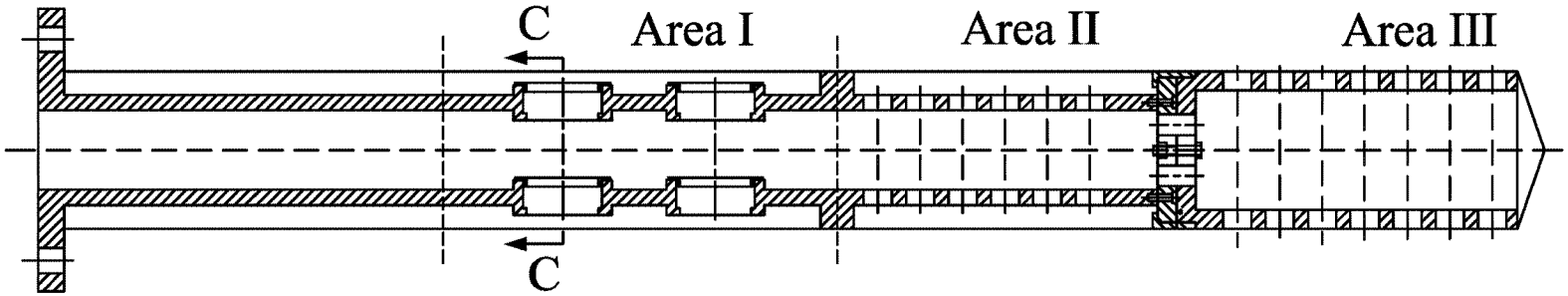
FIG. 13B is a front view of the detachable throttle pipe of the temperature regulation device in accordance with one embodiment of the disclosure.
Figure 13C:
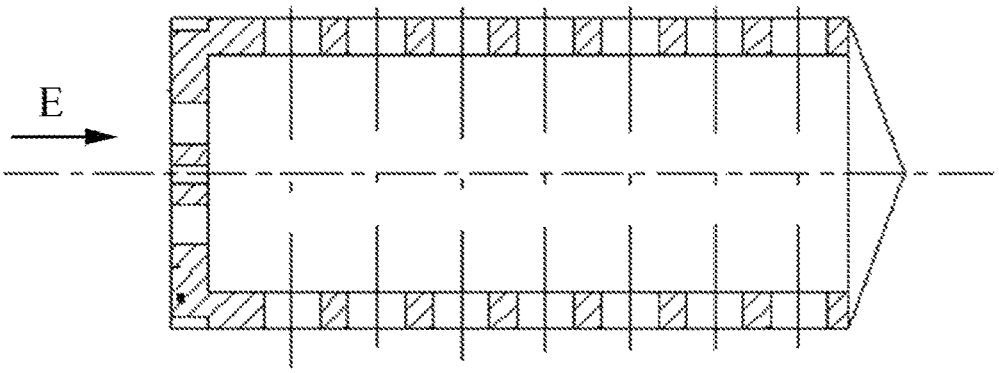
FIG. 13C is a schematic diagram of a second throttle device in an area III in accordance to one embodiment of the disclosure.
Figure 14A:
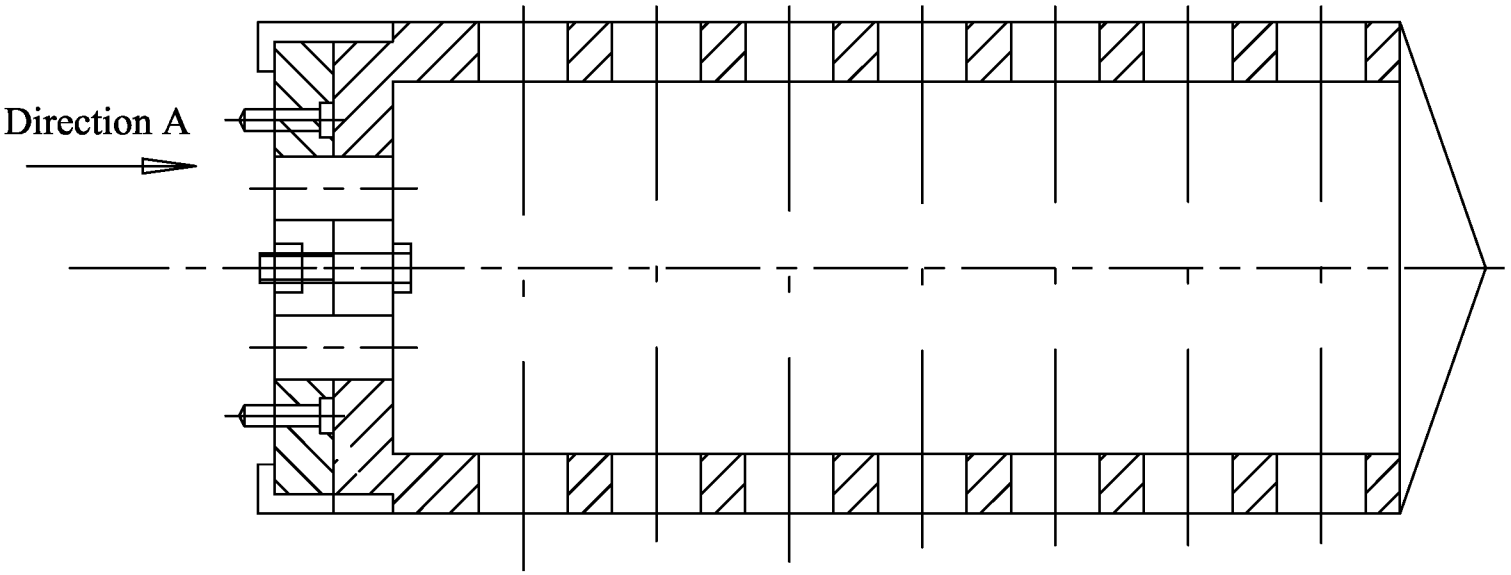
FIG. 14A is a sectional view of the second throttle device in accordance with one embodiment of the disclosure.
Figure 14B:
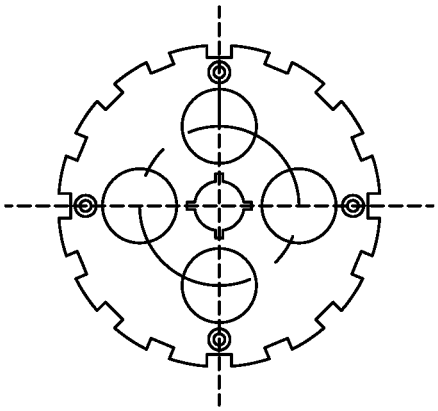
FIG. 14B is a view along the direction of A of FIG. 14A.
Figure 14C:
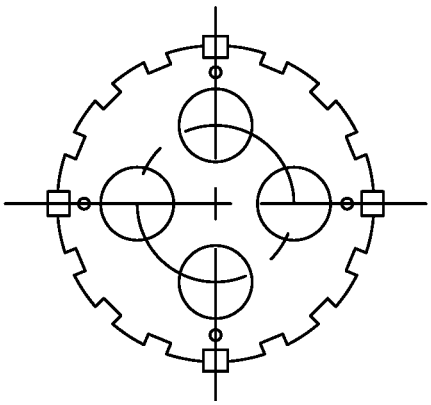
FIG. 14C is a view along the direction of E of FIG. 13C.
Figure 15A:
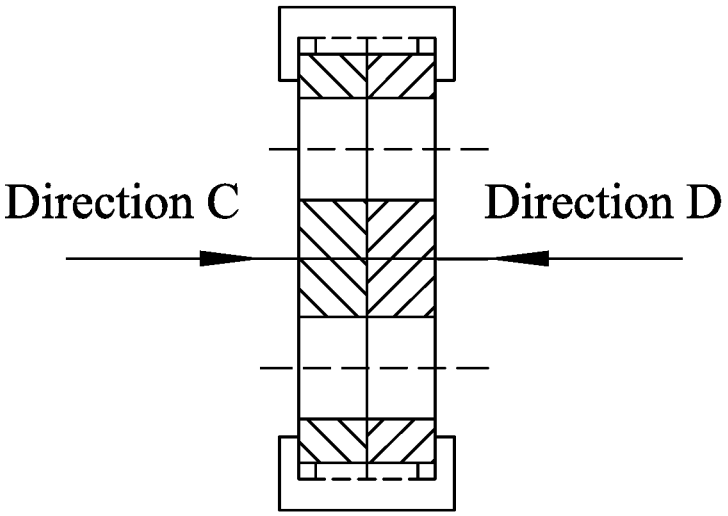
FIG. 15A is a sectional view of the first throttle device in accordance with one embodiment of the disclosure.
Figure 15B:
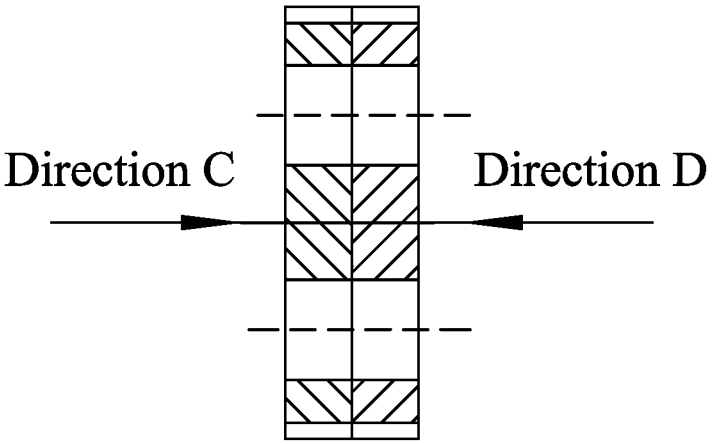
FIG. 15B is another sectional view of the first throttle device.
Figure 15C:
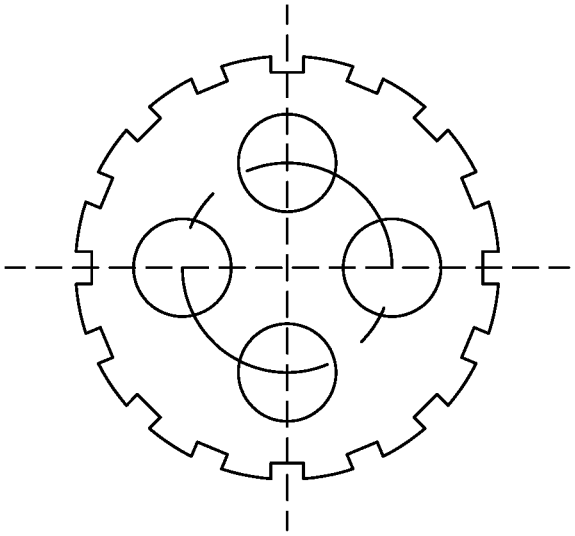
FIG. 15C is a view along the direction of C of FIG. 15A.
Figure 15D:
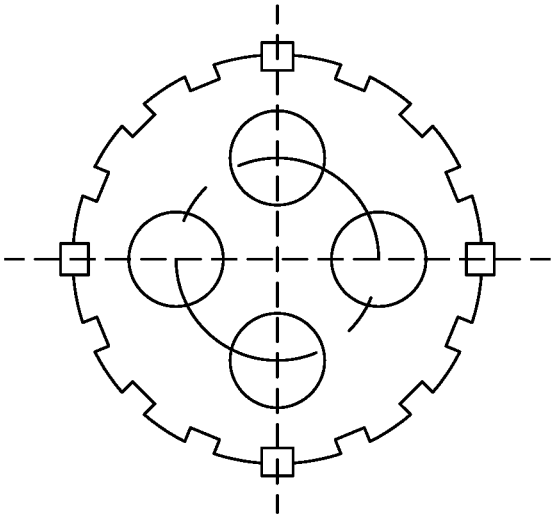
FIG. 15D is a view along the direction of D of FIG. 15A.

As shown in FIG. 9 and FIG. 10, the temperature regulatable cast-rolling roller comprises bearing seats 14 and 18, a bearing 15, a roller shell 16, a cast-rolling roller core with a cooling system 17, a quick-change flange 19, a water inlet gland cover 20, a water inlet pipe 21, a water outlet collect box 22, a water outlet pipe 23, cooling water inlet and outlet pipe 24 and 25, and a temperature regulation device 26. The roller core with the cooling system 17 contains cooling water passageways. The water inlet gland cover 20 is connected to the water inlet pipe 21 via the quick-change flange 19. The water inlet pipe 21 is connected to the temperature regulation device 26. Cooling water enters the water inlet pipe 21 through the water inlet gland cover 20, flows into the temperature regulation device 26, and is injected into the cast-rolling roller core with the cooling system 17. Two adjacent passageways in the roller core 17 are disposed orthogonally. Cooling water reaches the surface of the roller core 17 to cool the roller shell 16 to a lower temperature. The temperature regulation device 26 comprises a detachable throttle pipe 28, a first throttle device 29, and a second throttle device 30.

The cast-rolling apparatus with an area temperature regulatable roller further comprises an infrared roller surface temperature scanner. The infrared roller surface temperature scanner is provided on the mill frame for detecting the surface temperature of the cast-rolling roller.

As shown in FIG. 9, the cooling passageways in the temperature regulatable cast-rolling roller are distributed evenly in the roller body. According to the process requirements for the product, sizes of the cast-rolling roller and the water inlet pipe can be calculated by an empirical formula, and a rough range of sizes of the water outlet pipe and the passageways can be derived based on hydrodynamics. Then, depending on the actual condition of the cast-rolling roller surface temperature detected in the field, a series of temperature regulation devices 26 are matched to substantially determine various locations of the areas in different processes. Thereafter, sizes of opening channels in the first throttle device 29 and the second throttle device 30 are finely adjusted, so as to reach optimum area temperatures suitable for cast rolling.

The roller core with cooling system 17 cools the roller shell 16 to a temperature suitable for cast rolling by circulation of the cooling water.

The cast rolling apparatus according to the disclosure is operated as follows:

As shown in FIG. 9 and FIG. 10, according to the process requirements, regulation of the roller body surface temperature is effected by changing the flow and flow rate of the cooling water. Cooling water is introduced into the water inlet gland cover 20 through a rotary quick coupler, flows to the water inlet pipe 21, then into the temperature regulation device 26, and is injected into the roller core with cooling system 17 through the passageway arranged in the temperature regulation device 26. The infrared roller surface temperature scanner measures the cast-rolling roller surface temperature, from which the actual operating temperature of the cast-rolling roller is determined Based on the determined operating temperature of the cast-rolling roller, offline adjustment can be made to the temperature of the mill roller by the temperature regulation device 26 prior to further cast rolling processes.

The temperature regulation device 26 comprises a detachable throttle pipe 28, a first throttle device 29, and a second throttle device 30. The temperature regulation device 26 determines the area locations based on numerical simulation and temperatures measured through operational roller surface testing, and divides the roller body into three areas, the area I, the area III and the area III. The first throttle device 29 is installed in the area I based on the flow requirements. A cooling water channel in the area II pipe wall is aligned with the cooling water passageway in the roller body. A second throttle device 30, sized according to the water inlet pipe of the roller core 17, is installed between the area II and the area III, at the bottom of the detachable throttle pipe 28. The detachable throttle pipe separates the area I, the area II, and the area III. A protruded annular structure is provided on the throttle pipe in the area II for positioning the first throttle device 29. An annular baffle is provided in the throttle pipe between the area II and the area III for fixing the throttle pipe and the area throttle device as well as for separation of the area II from the area III. Uniform distribution of the surface temperature of the cast-rolling roller can be achieved by regulating the water flows in the areas I, II, and III through the temperature regulation device. During cast rolling, the roller body surface temperature may be non-uniform, with the temperatures in the areas I, II, and III being $T_1$, $T_2$, and $T_3$, respectively. Experiments suggest that temperature at either end portion of the cast-rolling roller generally drops faster, i.e., the temperatures $T_1$ and $T_3$ are lower than $T_2$. Therefore, in order to achieve uniform properties of the cast-rolled product and uniform temperature distribution in the product during cast rolling, the mill roller surface is required to be at a uniform and consistent temperature. The temperature regulation device 26 controls the water flows in the areas I, II, and III based on different temperature requirements. Assuming that the water flows in the areas I, II, and III are respectively $Q_1$, $Q_2$, and $Q_3$. These water flows should meeting the conditions of $Q_1<Q_2$ and $Q_3<Q_2$, in order to allow for consistent temperature drop over the cast-rolling roller surface.

The first throttle device 29 and the second throttle device 30 are engaged to each other via a pair of discs with distributed orifices. The relative positions of the two discs are adjusted depending on the desired water flow, in such a manner that the orifices in the discs are positioned to be aligned with or block each other, so as to control the water flow by regulating the cross section area through which the cooling water passes.

The detachable throttle pipe 28 can regulate the size of each of the three areas. The water flows in the area I and area III can further be changed by changing the areas of the first throttle device and the second throttle device. The larger the area is, the larger the water flow is. The water flow in the area II is controlled by changing the flow and flow rate of the water inlet. Further, a simple throttle device 27 is installed in the areas I and III in the roller body to adjust the water flow by adjusting the inserted length of the bolt.

The temperature regulation device 26 allows area temperature regulation for the surface of the cast-rolling roller, such that the molten alloy has uniform temperature distribution during cast rolling.

With the above technical solution adopted by the disclosure, cooling water is introduced into the cooling water circulation system of the cast-rolling roller body. Based on the temperature measured by the temperature scanner, the temperature regulation device regulates the water flows in various areas. As such, the drawbacks of existing sheet cast-rolling processes, such as uneven heating, difficult temperature regulation, and low yield of strips, can be overcome. Compared with conventional techniques, the disclosure has advantages of well controlled cast-rolling roller temperature, uniformity of cast-rolling roller temperature, and improved yield.

The invention claimed is:

1. A cast-rolling apparatus, comprising:
- a DC motor;
- a reducer gearbox;
- a two-stage cycloid pinwheel reducer;
- a cross-shaft universal coupling;
- a mill frame;
- a temperature regulatable cast-rolling roller, the temperature regulatable cast-rolling roller comprising a bearing seat, a bearing, a roller shell, a cast-rolling roller core, a quick-change flange, a water inlet gland cover, a water inlet pipe, a water outlet collect box, a water outlet pipe, and a temperature regulation device; the cast-rolling roller core comprising a cooling system and cooling water passageways;
- a screw-up cylinder;
- a spraying device;
- a guide roller; and
- a universal shaft end;

wherein:
- the temperature regulatable cast-rolling roller is mounted on the mill frame and connected to the cross-shaft universal coupling via the universal shaft end;
- the cross-shaft universal coupling is connected to the reducer gearbox, the two-stage cycloid pinwheel reducer, and the DC motor;
- the two-stage cycloid pinwheel reducer is transitionally connected to the DC motor via a jaw flexible coupling;
- the water inlet gland cover is connected to the water inlet pipe via the quick-change flange;
- the water inlet pipe is connected to the temperature regulation device; and
- two adjacent passageways in the roller core are disposed orthogonally.

2. The apparatus of claim 1, wherein the temperature regulatable cast-rolling roller comprise a first area, a second area, and a third area.

3. The apparatus of claim 2, wherein the temperature regulation device comprises a detachable throttle pipe, a first throttle device, and a second throttle device; the first throttle device is installed in the first area, and the second throttle device is installed between the second area and the third area.

4. The apparatus of claim 3, wherein the first throttle device and the second throttle device are engaged via a pair of discs comprising distributed orifices.

5. The apparatus of claim 1, further comprising an infrared roller surface temperature scanner; wherein the infrared roller surface temperature scanner is disposed on the mill frame for detecting a surface temperature of the cast-rolling roller.

* * * * *